US005655716A

United States Patent [19]

Mathis

[11] Patent Number: 5,655,716

[45] Date of Patent: Aug. 12, 1997

[54] INJECTION VALVE FOR AN INTERNAL COMBUSTION ENGINE, IN PARTICULAR A DIESEL MOTOR

[76] Inventor: Christian Mathis, Muttaweg 16, CH-7250 Klosters-Platz, Switzerland

[21] Appl. No.: 403,002

[22] Filed: Mar. 9, 1995

[30] Foreign Application Priority Data

Mar. 29, 1994 [CH] Switzerland ..... 00 936/94

[51] Int. Cl.[6] ..... F02M 47/02

[52] U.S. Cl. ..... 239/533.8; 239/533.9

[58] Field of Search ..... 239/533.2, 533.3, 239/533.4, 533.5, 533.9; 123/447, 458, 472

[56] References Cited

U.S. PATENT DOCUMENTS 4,566,416 1/1986 Berchtold ..... 123/458
4,719,889 1/1988 Amann ..... 123/447

FOREIGN PATENT DOCUMENTS 0 426 205B1 7/1993 European Pat. Off. .

*Primary Examiner*—Robert J. Oberleitner
*Assistant Examiner*—C. T. Bartz
*Attorney, Agent, or Firm*—Flynn, Thiel, Boutell & Tanis, P.C.

[57] ABSTRACT

An injection valve (2) for an internal combustion engine, in particular intended as a diesel motor, has a nozzle needle (15) movably arranged in a valve housing (47), which nozzle needle closes or opens an injection opening (4) leading into a fuel cylinder for an injection of fuel, and which nozzle needle extends with the opposite side thereof into a control chamber (17*a*), which is connected to a high-pressure part housing a control medium on the one side and through a conduit part (19) and a control valve (20) capable of closing said conduit part to a discharge conduit (10) on the other side. A further valve (25) is provided according to the invention, which valve has an annular chamber (28) connected to the high-pressure part of the control medium and an annular valve seat (27) closing said annular chamber on the front side. The valve seat is designed such that through an automatic opening thereof it creates an additional connection between the high-pressure part and the control chamber (17*a*) when the nozzle needle (15) carries out the closing movement, thus causing an increased closing speed by which said nozzle needle acts. With this an optimum injection sequence and also a permanent stable function of this injection valve and consequently a reduction of the exhaust emissions and an improvement of the efficiency of the diesel motor is achieved.

21 Claims, 5 Drawing Sheets

INJECTION VALVE FOR AN INTERNAL COMBUSTION ENGINE, IN PARTICULAR A DIESEL MOTOR

FIELD OF THE INVENTION

The invention relates to an injection valve for an internal combustion engine, in particular intended as a diesel motor, comprising a nozzle needle movably arranged in a valve housing, which nozzle needle closes or opens an injection opening leading into a fuel cylinder for the injection of fuel, and which extends on the opposite side into a control chamber. The control chamber is connected to a high-pressure part housing a control medium on the one side and to a discharge conduit on the other side through a conduit part and a control valve capable of closing said conduit part. A fluid-set valve is provided, which through an automatic opening creates an additional connection between the high-pressure part and the control chamber when the nozzle needle carries out the closing movement, causing an increased closing speed to act onto the nozzle needle.

DESCRIPTION OF THE RELATED ART

The control chamber, into which the nozzle needle extends with its upper end, is in an injection valve of the same class according to the EP-A10 426 205 which is connected on the one hand through a throttle bore to the high-pressure part and on the other hand through a bore and through a valve member, which closes the bore, to a discharge conduit. The pressure in the control chamber drops during opening of the control valve, which is designed as a magnetic valve, and the nozzle needle opens in response to the fuel acting unchanged with high pressure onto its underside that faces the injection opening. The nozzle needle moves up to an upper stop, which is formed by a fluid-set valve member. This valve member is thereby arranged coaxially with respect to the nozzle needle and its upper front side is loaded by the high-pressure part of the control medium namely over a cross section, which is formed by two or several bores arranged approximately vertically to the nozzle needle. With this the additional connection between the high-pressure connection and the control chamber is created directly after the closing of the magnetic valve because the high pressure acting in the bores presses the valve member against the nozzle needle and triggers the increased closing speed of the same. It is disadvantageous hereby that the mentioned flat front side of this valve member forms the valve seat, in which manufacturing exactnesses or wear appearances influence the function of this valve as a whole. Moreover there exists, for example, the danger that the repeatedly occurring pressure fluctuations of the high-pressure part can trigger an unintended closing of the valve.

SUMMARY OF THE INVENTION

Compared with the aforesaid the basic purpose of the invention is to further develop an injection valve of the above-described type such that an optimum closing speed of its nozzle needle is achieved, that with it a satisfactory and reliable functioning is guaranteed even after prolonged use and its manufacture can be accomplished easily and with little demands on the manufacturing tolerances.

The purpose is attained according to the invention by a valve that creates this additional connection between the high-pressure part and the control chamber which control chamber has an annular chamber connected to the high-pressure part of the control medium and an annular valve seat forming said chamber on the front side.

In comparison with conventional valves, the inventive design of the injection valve achieves a significant improvement with respect to its injection sequence and consequently a permanent function at a simultaneously low manufacturing expense of the same, because on the one hand this annular valve seat is subjected less to the danger that the valve seat no longer closes one hundred percent of the time upon the occurrence of contaminating particles in the control medium usually used as fuel, and on the other hand this inventive solution meets the demands for the quick feed of the desired control medium in its full amount in an ideal manner. A possible pulsating of the control medium pressure also does not result in an undesired opening of the valve because in contrast to the conventional solution the pressure acts onto the outer surface of the valve member and not in the direction of movement of the same. Thus the exhaust gas emissions can as a result be permanently reduced and an increased reaction speed of the same can be achieved, which speed has a very favorable effect on the control of these injection valves.

An advantageous embodiment has a bore in the control-valve member starting out from its valve seat on the front side and communicating with the conduit part, which bore is enlarged inside of the control-valve member for the purpose of generating a closing force acting in the closing direction of the same, and is moreover defined by a pin longitudinally movable in the control-valve member. The pin is supported at its upper end independently of the control-valve member. With this permanent loading of this control-valve member by an additional force in the closing direction is accomplished, thus resulting in an increased safety with respect to an undesired opening. Such a danger occurs in particular in the case of very high, nonpermissible pressures.

BRIEF DESCRIPTION OF THE DRAWINGS

The invention and further advantages of the same will be discussed in greater detail hereinafter in connection with the drawings, in which.

DETAILED DESCRIPTION

Figure 1:
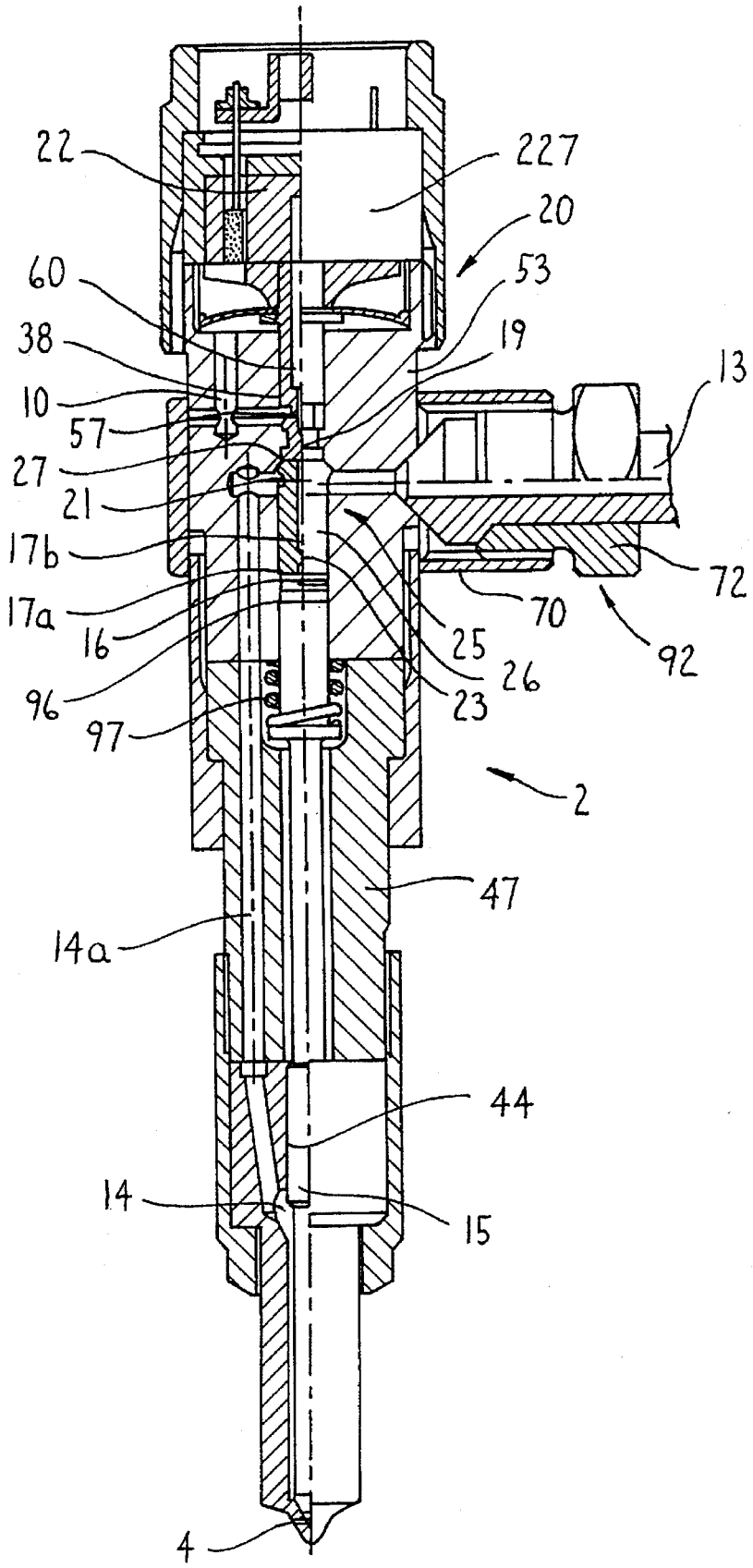
FIG. 1 is a longitudinal cross-sectional view of an injection valve of the invention.

FIG. 1 shows an injection valve 2 for an internal combustion engine, in particular, a diesel motor, which is not illustrated. The injection valve 2 is actually suited for common injection system of a diesel motor so that a detailed explanation thereof is not needed. It essentially has a multi-part valve housing 47, 53 with an injection opening 4 through which fuel is discharged into an engine cylinder. A single-part or multi-part nozzle needle 15 guided so as to be longitudinally movable in housing 47, 53. A valve 20 operates said nozzle needle and designed as an electromagnetic valve 227, a feed conduit 13 for the fuel under high pressure, and a discharge conduit 10. The nozzle needle 15 is surrounded in the lower part thereof by a storage chamber 14 which is fed with fuel from the feed conduit 13 through a feed bore 14*a*, and serves to close or open an injection opening leading into a fuel cylinder of the diesel motor or its supply conduit. It is guided in the center area in a fitted hole 44 of the valve housing 47, and projects with the upper end thereof into a control chamber 17*a* and is there pressed and furthermore supported by a pressure spring in a closing direction. The control chamber 17*a* is connected through to a supplementary chamber 17*b* through a valve bore 23 formed in a moving valve member 26. Valve member 26 has a transverse throttle bore 21 that provides fluid communication from the feed conduit 13 one side through supplemental chamber 17*b* and through the conduit part 19 and the control valve 20 to the discharge conduit 10. Since supplemental chamber 17*b* is connected to valve bore 23, throttle bore 21 also creates a first fluid path to valve bore 23 and control chamber 17*a*. A connection 92, which is disposed radial with respect to the injection valve 2 is provided for the feed conduit 13, which connection has a connecting ring 70 extending around the valve housing 47 and a threaded nut 72 pressing the feed conduit 13 against the housing 53.

Figure 2:
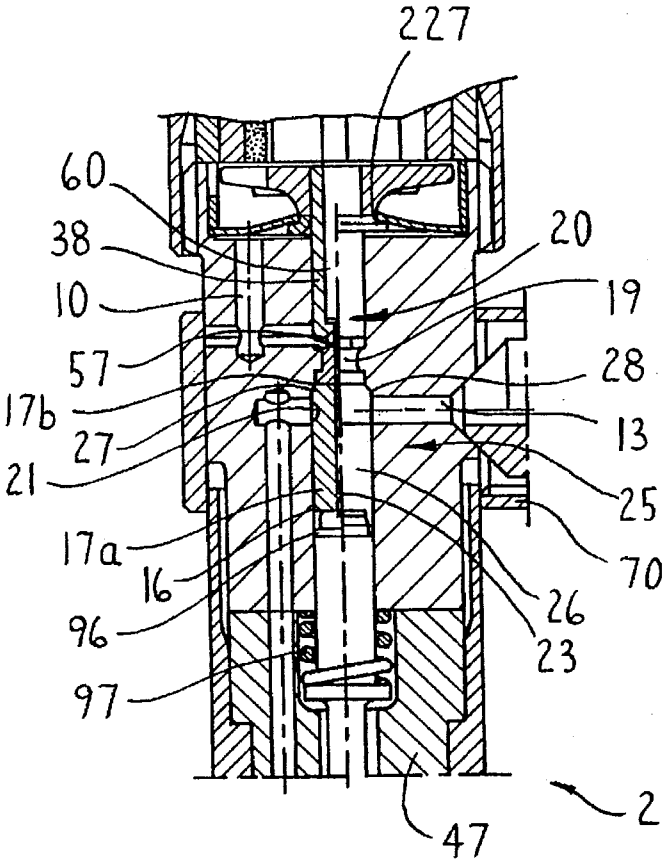
FIG. 2 shows a sectional view of the injection valve according to FIG. 1 with the nozzle needle in the open position.

According to the invention, a fluid-set valve 25 is arranged above said nozzle needle 15 in the injection valve 2 according to FIG. 2, includes the slidably movable valve member 26 seated in valve housing 47. Fluid-set valve 25 has through the feed conduit 13 an annular chamber 28 defined by a reduced diameter section of valve member 26. An annular valve seat 27 closing the chamber on top on the front side. The opening of valve 25, the movement of valve member 26 away from valve seat 27, creates an additional connection between chamber 28 and supplemental chamber 17*b* to valve bore 23 feed conduit 13 and the control chamber 17*a*. The valve 25 has for this purpose the valve member 26 extending coaxially with respect to the nozzle needle 15, which valve member is guided so as to be laterally sealed in the valve housing 47. This cylindrical valve member 26 and the valve housing 47 together form the annular chamber 28 and the valve seat 27 closing off said chamber 28. The valve member 26 thereby projects with the one front side, which faces the nozzle needle 15, into the control chamber 17*a* and with the other front side into a supplementary chamber 17*b* communicating with the discharge conduit 10 via the control valve 20. The supplementary chamber is connected to the control chamber 17*a* through a throttle bore 23, and adjacent to which is on the peripheral side the valve seat 27. Said valve seat is designed such that the valve member 26 rests with its upper inclined annular edge in the closing state sealingly against a corresponding annular surface in the housing bore wherein the annular chamber 28 surrounds the valve member 26 at least in its upper area. This conically designed valve seat 27 could, however, also be designed cylindrically or as a flat surface. Moreover, the valve member 26 has the transverse throttle bore 21 connecting the feed conduit 13 to the control chamber 17*a* through supplemental chamber 17*b* and valve bore 23, by means of which a permanent connection of the control medium from the high-pressure part into this control chamber takes place.

The valve member 26 is a predetermined distance from the nozzle needle 15 provided therebelow when in the closing position and between these moreover is provided a pressure spring 96 urging these parts apart. In the open position of the nozzle needle 15, which is caused by a release of the control valve 20 and a pressure drop related thereto in the control chamber 17*a*, this nozzle needle 15 impacts the lower front side 16 of the valve member 26. Directly after closing the control valve 20, there takes place on the one side through the transverse throttle bore 21 a pressure build-up first in the supplementary chamber 17*b*, thus causing the valve member 26 to be moved against the nozzle needle 15, and thus causing an automatic opening of the valve seat 27. An additional supply of the control medium, which is under high pressure, flows through this opening into the supplementary chamber 17*b* and the nozzle needle 15 is thus moved into the closing position with an increased speed by the valve member 26. After it has reached the closing position, the valve member 26 is moved back upwardly which movement is caused by the pressure buildup in the control chamber 17*a* and the spring-force support of the spring 96 namely until its upper annular edge is positioned in the housing bore and the valve seat 27 is thus again in closing position.

The valve member 26 advantageously has with its upper annular edge forming the valve seat 27 a similar or slightly smaller diameter than in its lower area, which lower area seals together with the valve housing 47. Thus the influence of pressure fluctuations in the supply pressure on the switching behavior of this valve member 26 can be practically eliminated.

The control-valve member 38 is furthermore pressed in the closing direction by an essentially plate-like spring element 58 held in the valve housing 47. The spring element is composed of triangular spring segments, which engage with their tips lying on the inside of the control-valve member.

Figure 3:
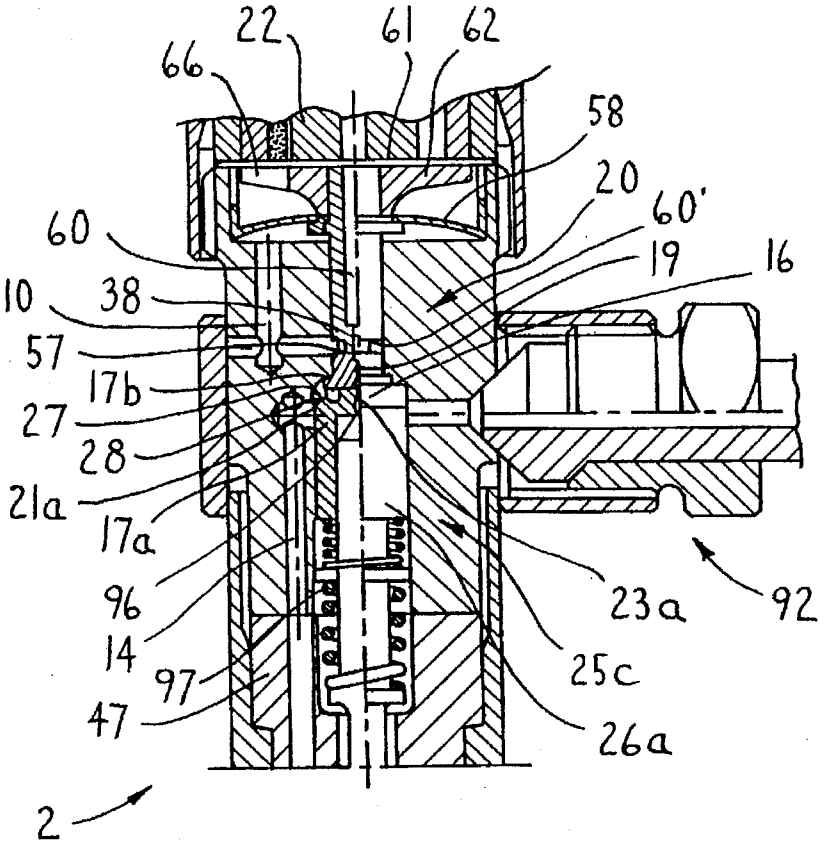
FIGS. 3 to 5 are each partially illustrated longitudinal cross-sectional views of a modified embodiment of an injection valve.

The valve member 26*a* shown in FIG. 3 is designed so as to be cylindrically-hollow wherein the nozzle needle 15 extends into said valve member. This makes possible a larger diameter of the valve-member cross section relative to the one of the nozzle needle and a reduction of the volume of the control chamber 17*a*, in particular because the pressure spring 96 is arranged outside of the valve member 26*a*. Furthermore, the permanent throttle bore 21*a* leads into the supplementary chamber 17*b*. This injection valve 2 is otherwise the same as the one according to FIG. 1 and its other characteristics are therefore not discussed in detail.

The control valve 20, which is designed as an electromagnetic valve 227, has a control-valve member 38, which closes or opens through a lower valve seat 57 on the front side of the vertical conduit part 19, which then transfers horizontal into a discharge conduit 10, in the valve housing 47. This control-valve member 38 has a bore 60' starting out from its valve seat 57 and communicating with the conduit part 19, which bore is enlarged inside the control-valve member 38 for the purpose of generating a closing force acting in the closing direction of the same. This bore 60' is for this purpose defined on top by a pin 60, which is arranged so as to be longitudinally movable and coaxial in the control-valve member 38. The pin is supported at its upper end independently of the control-valve member 38, in the present example on the lower front side of a pin arranged in the magnetic core 22 and having a sufficient hardness. An armature 62 is in addition fastened on the control-valve member 38 on the side not facing the valve seat 57, which armature forms a residual gap with respect to a magnetic core 22 of the magnetic valve, which also is in the open position, of the valve 20, which gap exists also between the pin 60 and the magnetic core 22. This residual gap causes in particular a quicker reactive behavior of the magnetic valve during turning off, which indirectly has a positive effect on the exhaust gas emissions and the efficiency of the internal combustion engine. A nonmagnetic, possibly perforated foil plate 61 is therefore arranged between the flat lower front side of the magnetic core 22 and the upper front surface of the magnetic armature 62, which foil plate determines the residual gap. The pin 60 has thereby a front side play towards the control-valve member 38, also when the magnetic valve 227 is activated. The magnetic core 22 rests with its lower flat front side directly on the foil plate 61, which in turn is fixed on the flat annular surface of the valve housing. Moreover, recesses 66 exist in the armature 62, through which recesses the fuel surrounding said armature can circulate during movement of the armature. The damping action of the back and forth moving control-valve member 38 can be adjusted by suitably choosing the cross section of the recesses 66.

Figure 4:
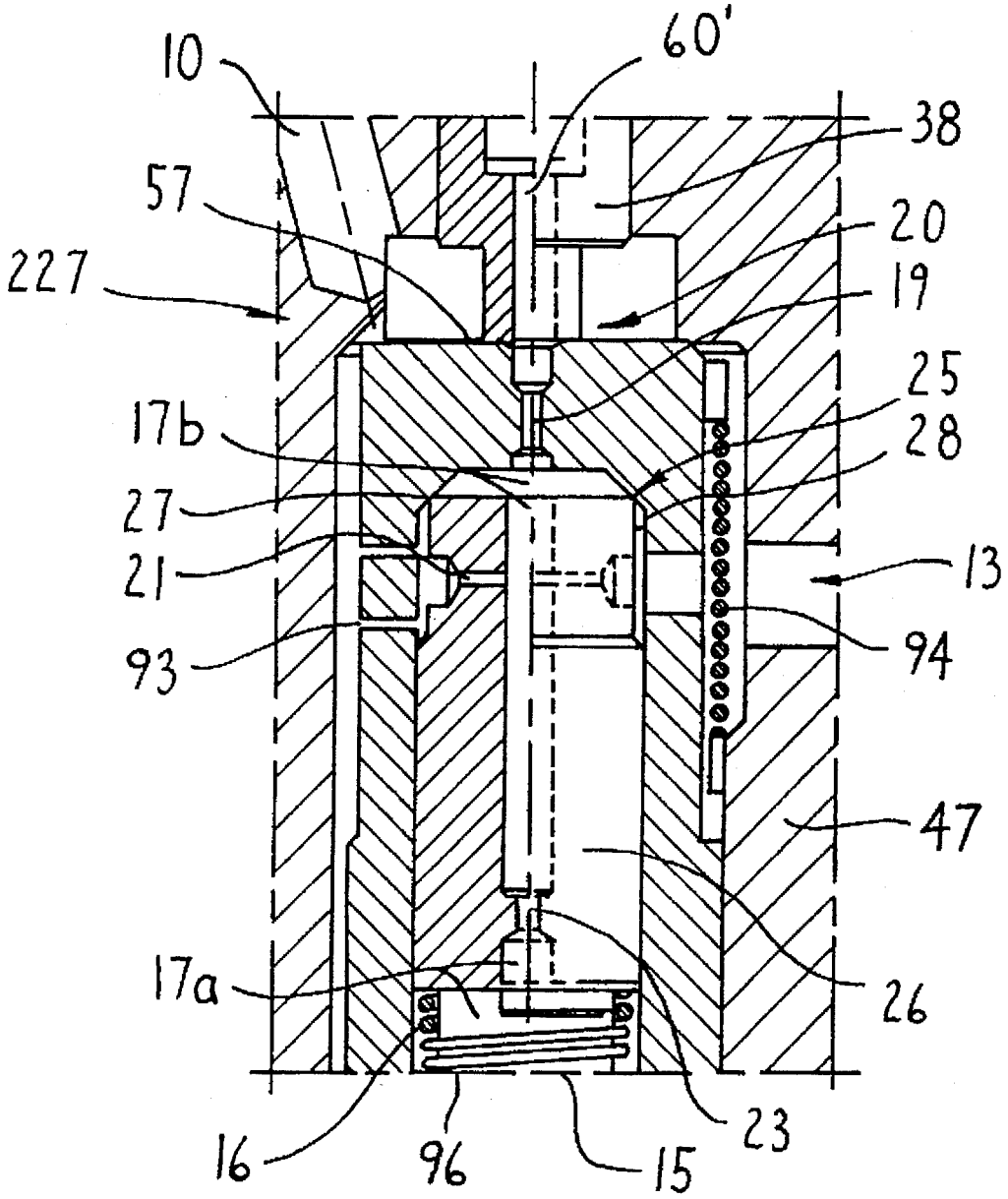

The conduit leading into the annular chamber 28 and constructed in the valve housing 47 is in FIG. 4 a further modification of the injection valve 2 that is formed of several nozzle openings 93 or of a fine-mesh sieve 94. Both filter inserts are both shown, however, in practice alternatively the one or the other would be utilized and not both together. Furthermore, the cylindrical valve member 26 is slightly reduced in diameter in the area forming the annular chamber 28 compared with the lower area guided in a cylinder part of the valve housing 47. Thus it is possible to manufacture the bore in the cylinder part of the valve housing 47 with an unchanged diameter.

Figure 5:
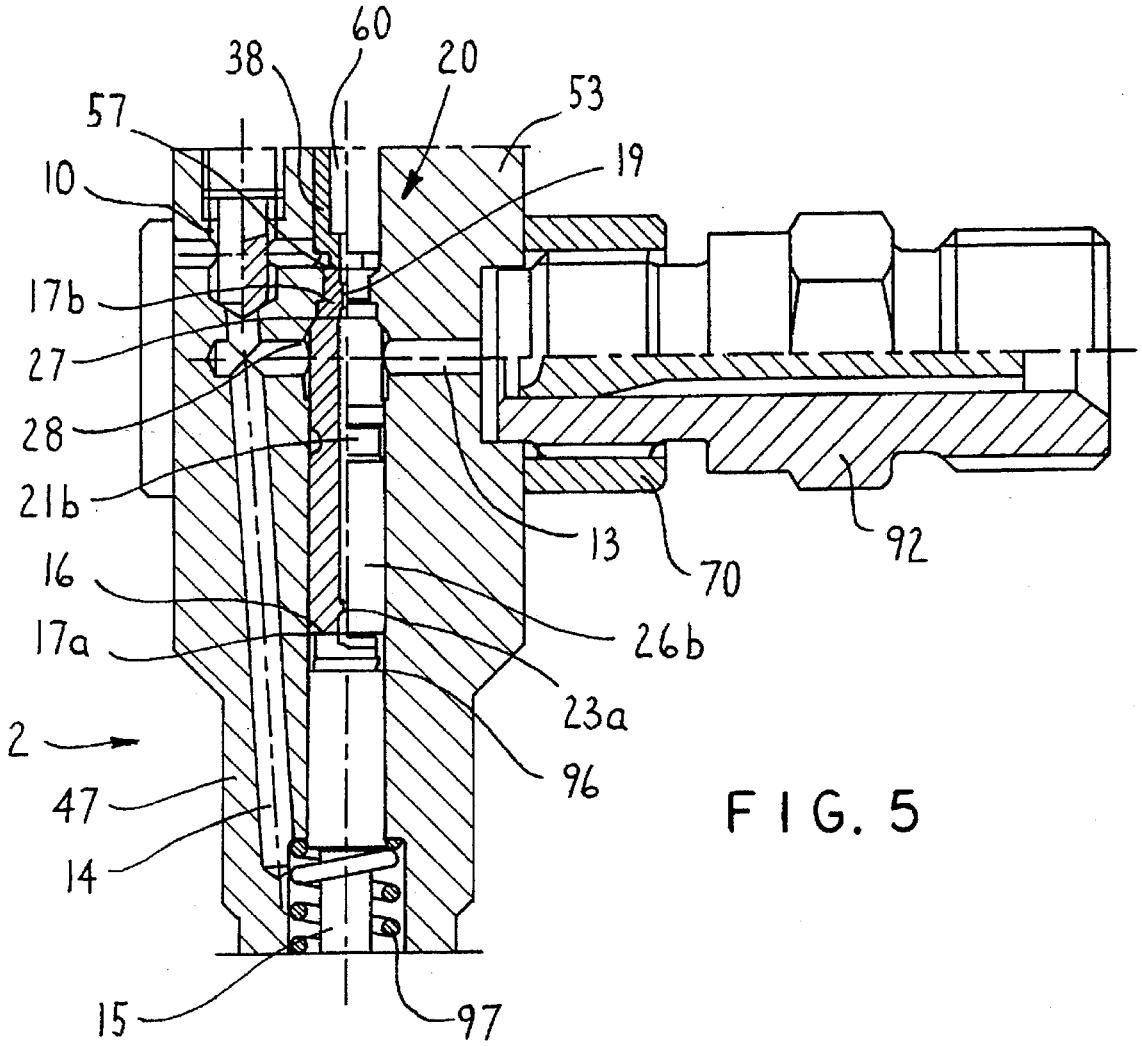
Figure 8:
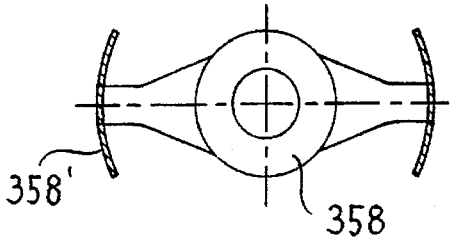
FIGS. 7 to 9 are each a top view of a spring element of the control valve.
Figure 6:
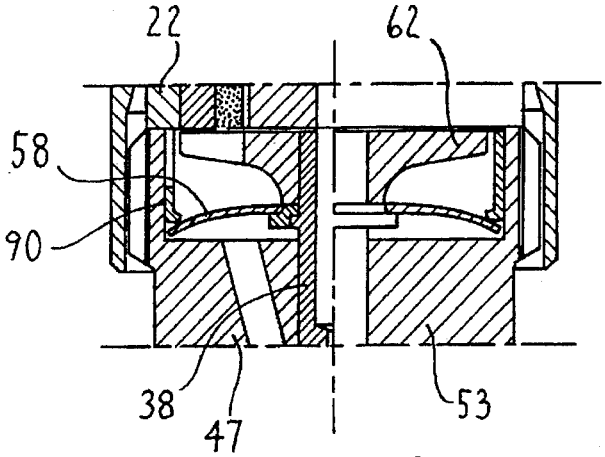
FIG. 6 is a longitudinal cross-sectional view of the control valve of the injection valve.
Figure 9:
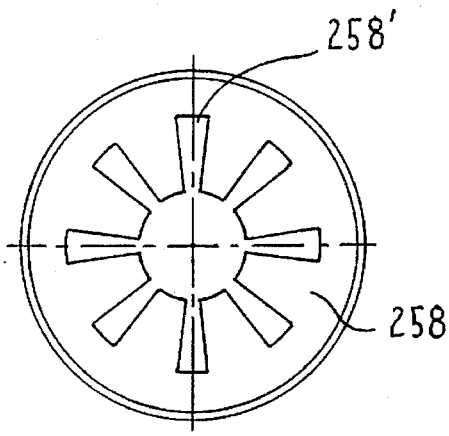
Figure 7:
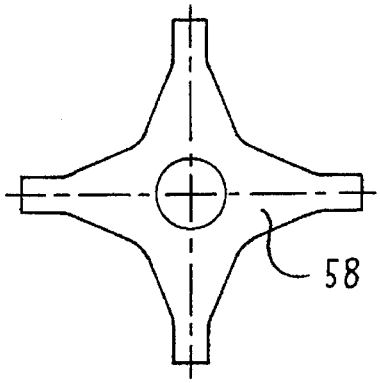

The injection valve 2 according to FIG. 5 shows once more a different modification of a valve member **26*b*, in which the transverse throttle bore 21*b* is arranged below the annular chamber 28** and a narrow annular gap therebetween creates a certain filter action.

A single nozzle opening 93 or rather the cross section of a mesh of the sieve 94 or the gap dimension of the mentioned narrow annular gap are thereby chosen to be smaller than the diameter of the throttle 21 determining the through-flow. Thus particles are caught before they can plug up the throttle 21. Especially in the case of injection valves 2 for larger motors, a division of the throttle 21 into several smaller cross sections is advantageously provided. The plugging up of an individual cross section does indeed then influence the operation, however, it does not cause a destruction of the internal combustion engine, as this can happen in existing injection valves.

Various modifications of spring elements are shown in FIGS. 6 to 9. According to FIG. 6, each are fixed on the outer periphery of a spacer ring 90 against the valve housing 47, and through which extends the control-valve member 38, which control-valve member is pressed away from the magnetic core 22 in the closing direction by each one spring element. The spring element 58, 358, 258 can be designed crosslike as a leaf spring 358 with lateral support plates 358' or platelike with radial slots 258'. These novel spring elements are on the one hand very inexpensive to manufacture, since they can be produced of a punching steel, and on the other hand prevent during operation the generation of a separate vibration thereof. However, due to the small mass of these spring elements they cause a quick reaction of the valve.

The control medium flowing in the control chambers is usually a fuel, which also is injected into the storage chamber and thereafter through the injection openings into a fuel cylinder. In principle, however, it would also be possible to use a separate fluid as the control medium, whereas the fuel would be intended only for the injection.

The valve seat 27 causes, as mentioned, a complete closing of the annular chamber 28, however, it would also be conceivable that the same could be provided with one or several recesses, and this valve would thus function as a throttle valve.

I claim:

1. An injection valve for an internal combustion engine comprising a valve housing with an injection opening, an elongated, movable nozzle needle disposed in the valve housing having a first end located adjacent the injection opening for opening and closing the injection opening, and a second end opposite the first end, a control chamber defined in the valve housing so as to be located adjacent the second end of the nozzle needle, a feed conduit formed in the valve housing for providing a control medium to the control chamber, a discharge conduit formed in the valve housing, a conduit part disposed in the valve housing for providing a fluid communication path between the control chamber and the discharge conduit, a control valve controlling fluid flow from the conduit part to the discharge conduit and a fluid-set valve disposed in the valve housing having an opening that creates a connection between the feed conduit and the control chamber when the nozzle needle is moved to close the injection opening so as to increase the speed at which the nozzle needle closes the injection opening, the improvement wherein the fluid-set valve includes: an annular valve seat formed by the valve housing; a movable valve member disposed in said valve housing so as to be located between the control chamber and said valve seat, said valve member having a switching end located adjacent said valve seat and being formed to define a valve bore that provides a fluid communication path between said switching end of said valve member and the control chamber and an internal throttle bore that forms a first fluid communication path between the feed conduit and said valve bore; and a valve chamber defined by a separation between the valve housing and said switching end of said valve member, said valve chamber being connected to the feed conduit, wherein when said switching end of said valve member is disposed against said valve seat, said valve chamber is blocked from fluid communication with the switching end and when said switching end of said valve member is spaced from said valve seat, said valve chamber is in fluid communication with said switching end of said valve member so as to form a second fluid communication path from the feed conduit to the valve bore and into the control chamber.

2. The injection valve according to claim 1, wherein said valve member of said fluid-set valve is shaped so as to have an end adjacent the nozzle needle that is cylindrically-hollow so that the control chamber is at least partially defined by said cylindrically-hollow portion of said valve member.

3. The injection valve according to claim 1, wherein: said valve member of the fluid-set valve has an upper annular edge and when the fluid-set valve is in the closed state, said upper annular edge of the valve member sets sealingly against the valve seat; and the valve seat is formed to have a cross-section profile that is conical, cylindrical or flat.

4. The injection valve according to claim 1, wherein: said valve member of the fluid-set valve extends coaxially with respect to the nozzle needle, moves longitudinally sealingly in the valve housing, has a first end that extends into the control chamber so as to face the nozzle needle, and a second end that defines a supplementary chamber communicating with the discharge conduit through the control valve; said supplementary chamber being connected through said throttle bore to the feed conduit and through said valve bore in said valve member to the control chamber; and said valve seat of said fluid-set valve and the valve housing adjoins said supplementary chamber so that said valve seat separates said supplementary chamber from said valve chamber of said fluid-set valve when said fluid-set valve is closed.

5. The injection valve according to claim 1, wherein: skid valve member of said fluid-set valve is spaced from the nozzle needle when the nozzle needle closes the injection opening, a pressure spring is provided between said valve member and the nozzle needle that urges said valve member and the nozzle needle apart and when the nozzle needle is urged into the open position by a pressure drop in the control chamber created by the opening of the control valve, the nozzle needle strikes an adjacent end of said valve member.

6. The injection valve according to claim 1, wherein the nozzle needle has a diameter and said valve member of said fluid-set valve has a larger diameter at the end thereof projecting into the control chamber than the diameter of the nozzle needle.

7. The injection valve according to claim 1, wherein the control valve that closes the opening in the conduit part includes a control-valve member in the valve housing that selectively covers an opening formed in the conduit part that leads into the discharge conduit, said control-valve member having a valve seat that covers the opening formed in the conduit part, and a bore extending from the valve seat that is in fluid communication with the opening in the conduit part, the bore in the control-valve member being enlarged inside of the control-valve member for the purpose of producing a closing force acting in a closing direction of the control-valve member, and having a pin longitudinally movable in the control-valve member, said pin being supported independently of the control-valve member.

8. The injection valve according to claim 8, wherein the control valve is designed as an electromagnetic valve having a magnetic core and an armature connected to said control-valve member at an end distal to the valve seat wherein said pin extends between said magnetic core and said control-valve member; and said armature, when said magnetic core of said electromagnetic valve has been activated, maintains a residual gap with respect to said magnetic core, said gap extending along a partial length of said pin between the control-valve member and the magnetic core.

9. The injection valve according to claim 8, wherein between a lower front side of said magnetic core of said electromagnetic valve and an upper front surface of the armature there is a nonmagnetic foil plate determining said residual gap.

10. The injection valve according to claim 7, wherein the control-valve member of said control valve is urged in the closing direction by at least one triangular spring element disposed in the valve housing.

11. The injection valve according to claim 10, wherein said at least one spring element engages with the inside of the control-valve member and is designed crosslike as a leaf spring with lateral support sheet-metal plates or is platelike with radial slots.

12. The injection valve according to claim 10, wherein, a filter is located in the valve housing of said fluid-set valve and in fluid communication with the feed conduit for the purpose of preventing contaminate flow through the throttle bore.

13. The injection valve according to claim 12, wherein said filter consists of at least one from the set of: a plurality of nozzles formed in the valve housing; the positioning of the throttle bore in said valve member of the fluid-set valve so as to be below said switching end of said valve member and the formation of a gap between the valve housing and said valve member wherein said gap is located between the feed conduit and the throttle bore so as to function as said filter; and a fine mesh sleeve seated in the valve housing.

14. The injection valve according to claim 12, wherein said filter consists of a plurality of nozzle openings formed in said valve member of said fluid-set valve and said nozzles form said throttle bore in said valve member .

15. An injection valve for supplying fuel from a fuel source to an internal combustion engine, said injection valve including:

an elongated valve housing, said valve housing having a first end and a second end distal from said first end and being formed to define: a feed conduit in said first end through which fuel is received from the fuel source; a discharge conduit in said first end wherein through which the fuel is discharged; an elongated hole that extends from said feed conduit to said second end; an injection opening in said second end that is in fluid communication with said elongated hole; and a feed bore connected in parallel across said elongated hole for providing fluid communication between said feed conduit and said injection opening;

an elongated nozzle needle seated in said elongated hole formed in said valve housing, said nozzle needle having a first end positioned adjacent said injection opening formed in said valve housing to control fuel flow through said injection opening and a second end distal front said first end;

a conduit part disposed in said valve housing adjacent said discharge conduit, said conduit part being formed with a discharge opening that provides fluid communication between said elongated hole in said valve housing and said discharge conduit;

a control valve attached to said valve housing, said control valve having a moveable valve member for selectively opening and closing said discharge opening formed in said conduit part so as to control fluid flow from said elongated hole in said valve housing to said discharge conduit; and a fluid-set valve located in said elongated hole formed in said valve housing so as to be located next to said feed conduit, said fluid-set valve including:

an annular valve seat defined by said valve housing so as to extend into said elongated hole so as to be located at a position between said feed conduit and said conduit part; and a moveable valve member located in said elongated hole so as to be located between said valve seat and said second end of said nozzle needle, said valve member having a first end located adjacent said nozzle needle and a second end adjacent said valve seat and being shaped to define: a control chamber in said elongated hole between said second end of said nozzle needle and said first end of said valve member; a supplemental chamber in said elongated hole between said conduit part and said second end of said valve member; a valve bore in said valve member that provides fluid communication between said control chamber and said supplemental chamber; a throttle bore that extends transversely through said valve member so as to provide a fluid communication path between said feed conduit and an opposed side of said valve member wherein said throttle bore is in fluid communication with said valve bore; and a valve chamber that is defined by said valve member and said valve housing so as to be located adjacent to said valve seat and so as to be in fluid communication with said feed conduit, wherein when said valve member is disposed against said valve seat, fuel flow from said valve chamber to said supplemental chamber is blocked and when said valve member is spaced from said valve seat, fuel flows from said valve chamber to said supplemental chamber so that fuel introduced to said valve chamber from said feed conduit flows through said valve chamber, said supplemental chamber and said valve bore into said control chamber.

16. The injection valve of claim 15, wherein said valve member of said fluid-set valve is further shaped so that said control chamber is at least partially located in said valve member.

17. The injection valve of claim 15, wherein said valve member of said fluid-set valve is further shaped so that said supplemental chamber is at least partially located in said valve member.

18. The injection valve of claim 17, wherein said throttle bore of said valve member of said fluid-set valve is connected to said portion of said supplemental chamber located inside said valve member so as to provide a fluid communication path from said feed conduit to said valve bore through said supplemental chamber.

19. The injection valve of claim 15, wherein said valve member of said fluid-set valve is further shaped so that said throttle bore is substantially aligned with said feed conduit.

20. The injection valve of claim 15, further including a spring disposed in said elongated hole of said valve housing for urging said nozzle needle and said valve member of said fluid-set valve apart.

21. The injection valve of claim 15, wherein said valve housing is shaped to define said valve seat of said fluid-set valve so that said valve seat has a cross-sectional profile that is conical, cylindrical or planar.

* * * * *

UNITED STATES PATENT AND TRADEMARK OFFICE

CERTIFICATE OF CORRECTION

PATENT NO. : 5 655 716

DATED : August 12, 1997

INVENTOR(S) : Christian MATHIS

It is certified that error appears in the above-indentified patent and that said Letters Patent is hereby corrected as shown below:

Column 7, line 1; change "skid" to ---said---;

line 6; change the second occurrence of "and" to ---and,---;

line 28; change "according to claim 8" to ---according to claim 7---; and line 54; change "and in" to ---and is in---.

Column 8, line 10; delete "wherein"; and line 24; change "front" to ---from---.

Signed and Sealed this

Third Day of February, 1998

*Attest:*

BRUCE LEHMAN

*Attesting Officer*

*Commissioner of Patents and Trademarks*